US005440134A

United States Patent [19]

Lough et al.

[11] Patent Number: 5,440,134

[45] Date of Patent: Aug. 8, 1995

[54] INFRARED BORESCOPE-THERMAL

[75] Inventors: Lewis E. Lough, Springfield; Donald A. Ferrett, Manassas, both of Va.

[73] Assignee: The United States of America as represented by the Secretary of the Army, Washington, D.C.

[21] Appl. No.: 166,193

[22] Filed: Dec. 14, 1993

[51] Int. Cl.[6] ..... H01J 1/00

[52] U.S. Cl. ..... 250/504 R

[58] Field of Search ..... 250/504 R, 493.1, 495.1

[56] References Cited

U.S. PATENT DOCUMENTS

| | | | |
|---|---|---|---|
| 4,168,429 | 9/1979 | Lough | 250/330 |
| 4,262,198 | 4/1981 | Gupta et al. | 250/340 |
| 4,530,162 | 7/1985 | Forrest et al. | 33/228 |

*Primary Examiner*—Bruce C. Anderson

*Attorney, Agent, or Firm*—Milton W. Lee; John E. Holford; Alain L. Bashore

[57] ABSTRACT

A test target for thermal and similar rifle sights including a target, collimating lens in a housing with a mandrel type boresighting attachment.

5 Claims, 2 Drawing Sheets

INFRARED BORESCOPE-THERMAL

BACKGROUND OF THE INVENTION

1. Field of the Invention

The present invention generally relates to infrared night sights, particularly sights designed for mid or far-infrared, e.g. wavelengths of 3 to 5 or 8 to 14 microns, and adjustments thereof.

2. Description of Prior Art

When rifles are designed for use by snipers at long ranges they are fitted with telescopic sights. To accurately adjust such sights requires special gun vises and large specialized target ranges. Such arrangements are difficult when maintenance is done in a field depot. The process is still more involved when the sight is a night sight, i.e. it can be used in low level light or infrared light. In U.S. Pat. No. 4,168,429 "INFRARED BORESCOPE DEVICE AND METHOD OF BORESIGHT ALIGNMENT OF A WEAPON" issued 18 Sep. 1979 one of the present applicants solved a similar problem for a rifle equipped with an aiming light. The solution then was to mount a special light target and optical components on the weapon mechanically in alignment with the axis of the rifle bore. Unfortunately, this target cannot be used with passive type sights, particularly thermal night sights that operate in the mid or far-infrared.

SUMMARY OF THE INVENTION

According to the invention a thermal sight is boresighted to a weapon by adding a thermal target mechanically engaging the bore of the weapon, which is viewed through the sight while adjusting the latter.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
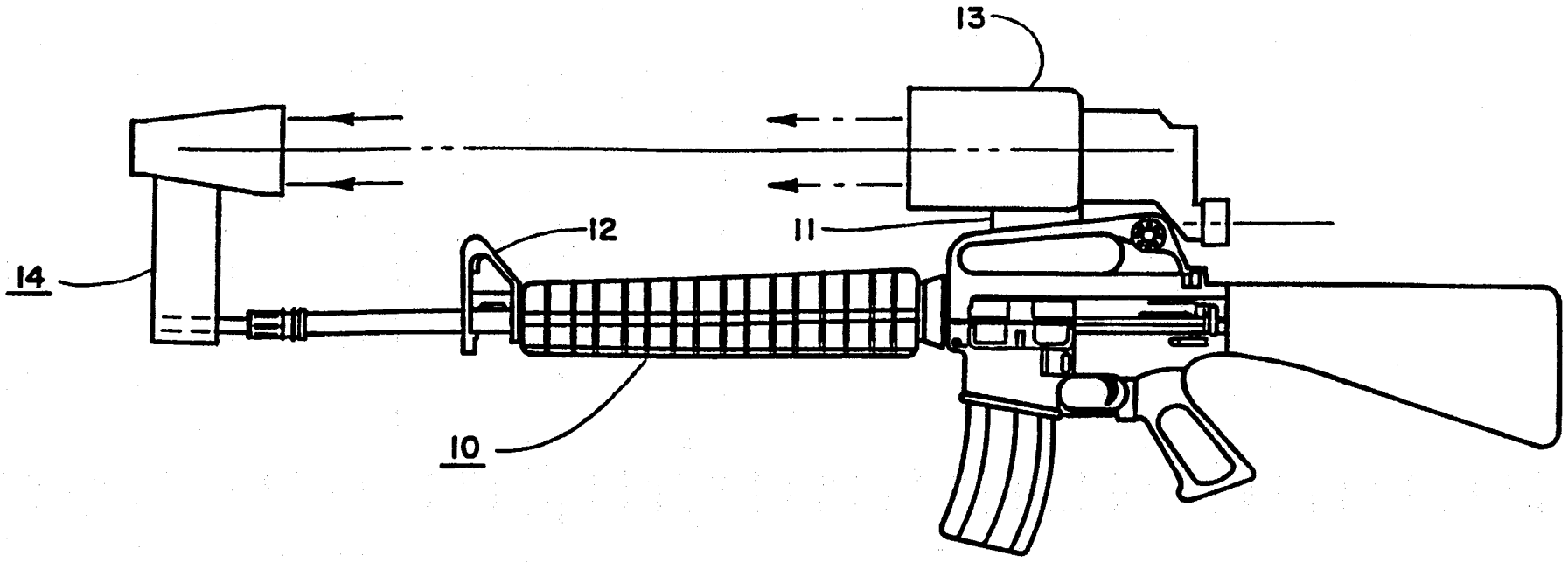
FIG. 1 is a side view of a weapon fitted with the borescope according the present invention.

Referring now to the drawings, and more particularly to FIG. 1, there is shown a side view of a currently issued rifle 10 used by the U.S. Army, Model M16. Above the balance point or center of gravity of this weapon, there is provided a mounting rail 11 carrying an integral fold-down peep sight (not shown) which cooperates with a solid front sight 12 at short ranges in the daylight. For longer ranges and poorer ambient light conditions, the rail is designed to accept telescopic day and night sights.

One very important type of night sight is the thermal sight 13. Most night sights use image intensifier tubes or near IR silicon detectors to amplify existing barely visible and invisible light. The thermal sight, however, detects variations in temperature by detecting mid or far-infrared radiation. This can be accomplished with special diodes of gallium arsenide or mercury cadmium telluride, preferably cooled to the temperature of liquid nitrogen. There are also thermoelectrically cooled and uncooled pyroelectric detectors, which provide fairly good contrast and resolution at room temperature, in this role. These sights cannot be aligned with the device described in applicant's patent, mentioned above, because they do not respond to visible and near-visible radiation. A similar device 14, however, is proposed by the present application.

Figure 2:
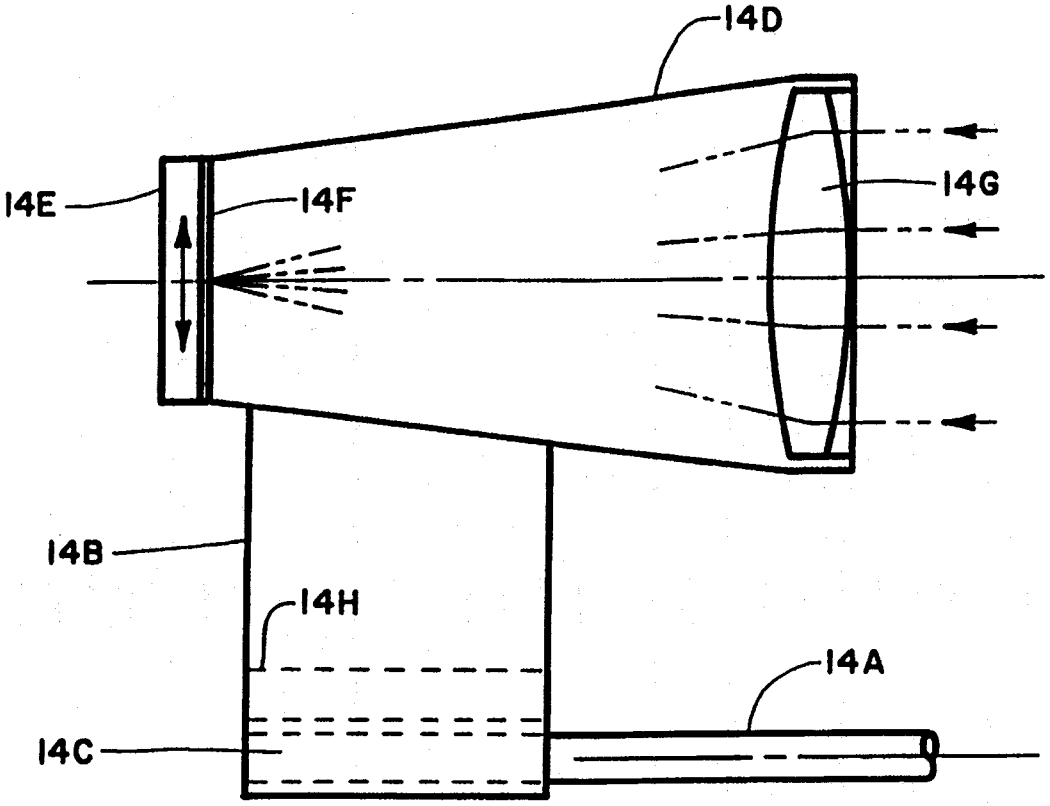
FIG. 2 is a cutaway side view of the borescope showing inner detail and the bore engaging mandrel.

FIG. 2 shows a cutaway view of this new test device. Like the previous device it includes a tapered or expandable mandrel 14A that can be inserted into the barrel of a rifle. The mandrel is made from a metal or plastic material softer than that of the barrel, so as to not damage the rifling therein. It is, however, tough and sufficiently resilient to retain its shape. A spacing arm 14B, having a normal rectangular cross-section, is drilled through near one end with the drill axis in that cross-section and parallel to the longest sides thereof. The end of the mandrel that protrudes from the barrel fits snugly into the hole 14C drilled through the arm.

The opposite end of this arm is integral with a normally truncated conical housing 14D, having an axis parallel to the drill axis above, which serves as an optical axis. The small circular opening at the truncated end is covered with a disk-shaped substrate 14E that does not appreciably absorb mid or far-infrared light. This disk is coated inside the housing with a thin uniform target layer 14F of material such as gold black, which is highly absorptive to that same light. The large circular opening at the opposite end of the housing is closed by a circular germanium lens 14G that collimates the light image of the target layer to simulate an image at infinite distance.

Figure 3:
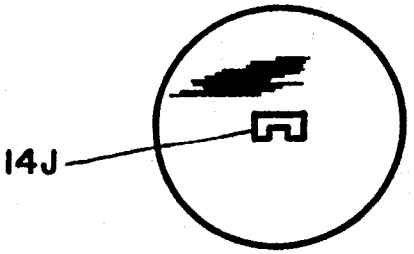
FIG. 3 is a shooter's or firer's view of the target structure in the borescope as seen through the thermal sight.

As shown in FIG. 3, the test target 14J consists of an aperture in the target layer. A wide rectangular opening with a smaller opaque rectangular projection extending to half the height of the opening represents a typical sighting silhouette. The coated substrate forms a shield to the mid or far-infrared radiation at the small end of the housing. Only such radiation that passes through the rectangular opening is focussed by lens 14G. Any warm object, e.g. a man's finger, can be placed behind the test target opening to create a target image. The rectangular opening may be filled with a mid or far-infrared transmitting material, such as germanium or zinc selenide, to seal out moisture or other contaminants that might obscure the target or damage the inner surfaces.

The spacing between the parallel axes of hole 14C and the optical axis of the housing equals the spacing between the bore axis of the rifle barrel and the optical axis of the objective aperture on the rifle sight. Since this will vary between different weapons additional mandrel holes or sockets, like socket 14H, may be drilled parallel to socket 14C, to reduce the number of borescopes required for a given rifle collection. Each new socket provides a closer vertical spacing than the previous socket. Adding staggered vertical columns of such holes permits smaller change increments in the spacing, if desired. Angular orientation of the mandrel about its axis to achieve alignment of the axis of the target housing 14D with the optical axis of the rifle sight can be achieved by eye. To save time an indicia mark, a projection or a recess, not shown may be provided on arm 14B which approaches or conacts a fixed feature near the end of the rifle barrel, such as the front metal sight 12. The objective aperture of the target housing preferably matches that of the rifle sight. Making the substrate and lens plug-in elements, according to well known practices in the art, simplifies maintenance of the test target. Replacing the target and lens with units that operate in the visible or near infrared permits testing of day sights and image intensifier sights with the same mandrel, arm and housing structure.

While this invention has been described in terms of preferred embodiment consisting of a rifle, a thermal night sight, a collimating lens and a target element in a housing, those skilled in the art will recognize that the invention can be practiced with modification within the spirit and scope of the appended claims.

Having thus described my invention, what we claim as new and desire to secure by Letters Patent is as follows:

1. A borescope for aligning the optical axis of a passive thermal night sight, responsive only to radiation in the mid and far infrared wavelength range and mounted on a rifle, substantially parallel with the bore axis of said rifle; comprising only:

a wafer of material that does not substantially absorb radiation in said range; coated on one side except for a central portion defining an aperture: with a material that absorbs substantially all radiation in said range;

a support means for mounting said wafer in a fixed normal relationship to said bore axis, with said aperture centered on said optical axis and said one side facing said sight;

said support means including an integral circularly cylindrical mandrel slightly smaller in diameter than the rifle bore extending into said bore for a substantial portion of its length; and a lens for collimating only ambient radiation in said range passing through said aperture toward said sight.

2. A borescope according to claim 1, wherein:

said substrate is mounted in one end of a truncated conical housing with an axis spaced from and parallel to the axis of said mandrel;

said lens comprises a refractive lens, made from a material substantially transparent to light in said range, mounted in the other end of said housing; and a support arm rigidly linking said housing to said mandrel.

3. A borescope according to claim 2, wherein:

said arm is adjustable in its dimension normal to said axes.

4. A borescope according to claim 2, wherein:

said support arm includes a number of hole into which the mandrel can be securely inserted, each hole providing a different spacing between the mandrel axis and wafer.

5. A borescope according to claim 2, wherein:

said lens is made of germanium.

* * * * *